US007251875B2

(12) United States Patent
Blumberg et al.

(10) Patent No.: US 7,251,875 B2
(45) Date of Patent: Aug. 7, 2007

(54) CALENDAR SLIDE AND HANGER TAPE

(75) Inventors: Murray B. Blumberg, Johannesburg (ZA); Eric R. de Beer, Johannesburg (ZA); Allan Gavronsky, Montgomery, OH (US)

(73) Assignee: Stuebing Automatic Machine Company, Cincinnati, OH (US)

( * ) Notice: Subject to any disclaimer, the term of this patent is extended or adjusted under 35 U.S.C. 154(b) by 269 days.

(21) Appl. No.: 11/051,948

(22) Filed: Feb. 4, 2005

(65) Prior Publication Data

US 2005/0184017 A1 Aug. 25, 2005

Related U.S. Application Data

(60) Provisional application No. 60/553,509, filed on Mar. 16, 2004.

(30) Foreign Application Priority Data

Feb. 5, 2004 (ZA) ..... 2004/0965

(51) Int. Cl.
*B42B 5/06* (2006.01)

(52) U.S. Cl. ..... 29/509; 412/38; 412/32.34; 29/788; 29/38; 29/13

(58) Field of Classification Search ..... 40/107, 40/592; 211/45; 402/70; 412/38, 32.34; 29/33.5, 13, 509, 788; D19/20; 281/21.1; 282/2; 283/2
See application file for complete search history.

(56) References Cited

U.S. PATENT DOCUMENTS 1,057,295 A * 3/1913 Stuebing ..... 29/33.52
1,906,024 A * 4/1933 Todd ..... 40/107
2,042,912 A * 6/1936 Stuebing, Jr. ..... 29/33.5
2,774,161 A * 12/1956 Dixon ..... 40/107
5,096,069 A * 3/1992 Brandon ..... 211/45
5,707,194 A * 1/1998 Blumberg et al. ..... 412/38
6,042,319 A * 3/2000 Hoffman ..... 412/34
6,698,988 B2 * 3/2004 Hoffman ..... 412/33
6,988,330 B2 * 1/2006 Gavronsky ..... 40/107
D522,053 S * 5/2006 Gavronsky ..... D19/20
D522,574 S * 6/2006 Gavronsky ..... D19/20

* cited by examiner

*Primary Examiner*—Lesley D. Morris
*Assistant Examiner*—Shin Kim
(74) *Attorney, Agent, or Firm*—Wood, Herron & Evans, LLP

(57) ABSTRACT

A calendar slide includes a hanger that is secured to the slide during the tinning or crimping process in which the slide is secured to the calendar. The hanger has a hole for hanging the calendar or other work piece tinned with the slide and hanger. Advantageously, according to this invention, the hanger does not need to be riveted or staked to the slide for secure attachment. The slide may include at least one through slot into which a leading edge of a roll of hanger material is inserted. The leading portion of the hanger material is severed or cut from the remainder of the roll while it is positioned in the hanger. An edge of the calendar or work piece is inserted between the spaced legs of the slide and initially crimped between the spaced legs. The hanger is severed from the roll either prior to the initially crimping operation, during the initial crimping operation or immediately there after. The crimping of the slide onto the edge of the calendar or work piece securely positions the hanger to the slide and calendar prior to the completion of the tinning process.

26 Claims, 8 Drawing Sheets

CALENDAR SLIDE AND HANGER TAPE

This claims the benefit of U.S. Provisional Patent Application Ser. No. 60/553,509, filed Mar. 16, 2004 and South African Patent Application Serial No. 2004/0965, filed Feb. 5, 2004, each of which is hereby incorporated by reference in its entirety.

BACKGROUND OF THE INVENTION

This invention relates to document slides. More specifically, this invention relates to an improved hanger for a document or calendar slide and the associated method and system for binding a document with such a slide and hanger.

Slides for binding a margin of a calendar, poster, and the like are well known. A slide is generally an elongate strip of metal which may be folded or crimped one or more times onto the margin of an item, such as a calendar or poster. Examples of slides are shown in U.S. Pat. Nos. 1,906,024 and 2,042,912, each of which are incorporated herein by reference in its entirety.

The vertex of the elongated V-shaped strip of sheet metal separates the two sides or legs of the V-shaped strip. Typically, one leg of the V-shaped strip is shorter or narrower, and the other leg is longer or wider. The slide also typically contains a hanger which may be a separate piece attached to the V-shaped sheet metal strip or is an eyelet stamped into the V-shaped sheet metal strip. The hanger of the first type is typically made out of plastic and is staked or attached at the approximate longitudinal center of the metal strip by one or more sheet metal burrs or rivets. The V-shaped strip of sheet metal is attached to a calendar by folding or crimping it onto the margin of the calendar. The hanger can then be used to hang and display the calendar at a desired location, e.g., a wall. The surface of the slide that is visible when it is displayed is often painted to prevent oxidization and for aesthetic purposes.

Attaching a slide to the margin or edge of a calendar, poster, or the like, is commonly referred to as "tinning". Tinning calendars is an economical means for finishing calendars that are commonly used by companies for advertising purposes. Also, it is advantageous to tin other hanging documents, such as posters, maps, and training guides, so that they may hang neatly and be easily moved from one location to another.

Certain known machines for tinning have been manual, fully automatic or semi-automatic so that large numbers of slides per hour may be applied to individual calendars. Such tinners are shown in U.S. Pat. Nos. 5,707,194; 6,042,319 and 6,698,988, each of which is hereby incorporated by reference in its entirety. A calendar is fed into the folded metal strip, whereafter the metal strip is cut to the width of the calendar to form the slide. The slide is then crimped upon the calendar to sandwich the calendar therein. Thereafter, the slide is folded a second time to produce a second bend which is then crimped back upon itself to complete the tinning process.

There are a number of problems with these prior art slides. First, the slides with a separate plastic hanger that is staked or riveted to the slide require added effort to accurately position and stake the plastic hanger to the slide. The rivets or stakes used to secure the hanger may snag or scratch items, including adjacent slides when arranged in stack or magazine of similar slides. Moreover, slides of this type require special handling during the tinning process as described in U.S. patent application Ser. No. 10/321,413, filed Dec. 17, 2002 and Ser. No. 10/369,408, filed Feb. 18, 2003, each of which is assigned to the assignee of this invention and hereby incorporated by reference in its entirety.

Another problem with known slides of the type in which the hanger is formed of an eyelet stamped from the metal of the slide itself is the difficulty a user encounters when hanging the calendar or other workpiece. One such problem is the opening in the eyelet is too small and not configured to accept the head of a nail, hook or other wall hanging device there through.

A further problem is that the user can not conveniently and easily access the eyelet hanger to bend it into place for use relative to the remainder of the slide. Typically, after the tinning process the hanger remains in place on the associated leg of the slide and juxtaposed to the back face of the calendar or workpiece. The hanger must then be bent or folded relative to the remainder of the slide so that it projects upwardly from the top edge of the slide and calendar and is accessible for hanging. However, known eyelet hangers stamped into the slide can be very difficult to access and bend relative to the slide once the slide is tinned onto the calendar.

As such, an improved calendar slide and hanger and associated system and method of tinning are needed that overcomes these and other problems with known slides and hangers of this type.

SUMMARY OF THE INVENTION

These and other objectives of this invention are achieved with an improved slide and hanger configuration as well as associated system and method of tinning a work piece. More specifically, in the various embodiments of this invention, a calendar slide includes a hanger of plastic, Mylar or other material that is secured to the hanger and includes a hole for hanging the calendar or other work piece tinned with the slide and hanger. Advantageously, according to this invention, the hanger does not need to be riveted or staked to the slide for secure attachment.

In one embodiment of this invention, the slide includes at least one through slot into which a leading edge of a roll of hanger material is inserted. Alternatively, a standard slide without a slot may be used and the leading edge of the roll of hanger material is inserted between the legs of the slide. The leading portion of the hanger material is severed or cut from the remainder of the roll prior to tinning or while it is positioned in the slide. An edge of the calendar or work piece is inserted between the spaced legs of the slide and initially crimped between the spaced legs. The hanger is severed from the roll either prior to the initial crimping operation, during the initial crimping operation or immediately there after. The crimping of the slide onto the edge of the calendar or work piece securely positions the hanger inserted in the slot or between the legs of the slide prior to the completion of the tinning process.

In various embodiments of this invention, multiple hangers may be inserted into spaced slots in the slide and the slots may be positioned on the shorter leg, longer leg and/or the juncture or bight portion between the legs of the slide. This invention also includes the machine, system and associated method for tinning the calendars with these slides and hangers as well as the hangers and slides themselves.

According to another aspect of the invention, a supply of flexible hangers for a bound sheet of paper comprises a roll of preformed hangers. The preformed hangers may be formed in a length of tape. Conveniently, each performed hanger has a central opening which forms an eyelet. The tape may include feeding formations such as a multiplicity of sprocket holes engageable with a feed sprocket to allow a predetermined length of tape to be advanced and severed therefrom to provide a hanger. The sprocket holes may be centrally located, with one of them defining the eyelet opening, or they may be adjacent the sides of the tape. Conveniently, the tape may be of a suitable synthetic plastic.

Another aspect of the invention is a method of binding a sheet of paper. The method may include the step of positioning an end of the sheet of paper to be bound in between two legs of a partially folded slide or binding strip. An edge of a preformed hanger is also inserted between the sheet of paper and one of the two portions of the slide. The slide is then deformed or crimped with the end of the sheet of paper and the hanger therein to secure the sheet of paper and hanger thereto.

In particular, the hanger may be supplied from a length of tape in roll of interconnected preformed hangers. Thus, the method may include separating a preformed hanger from the tape. The method may also include forming the binding strip or slide.

A further aspect of the invention is an apparatus for binding a sheet of paper including a slide or binding strip supply mechanism for supplying a partially folded over binding strip having two legs or portions angularly disposed about a fold line, from a supply thereof.

A hanger supply mechanism is also included for supplying a preformed hanger having an eyelet opening from a supply thereof. A hanger feed mechanism feeds an edge of the hanger distal from the eyelet opening between an end of a sheet of paper located in a region between the legs of the binding strip. A deforming or crimping mechanism deforms the binding strip with the end of the sheet of paper and the hanger therein, to secure the sheet of paper and hanger thereto.

The preformed hangers may be supplied in a length of tape, preferably as a roll, and the hanger supply mechanism may thus include a support for the roll and suitable feed rollers. A reciprocating cutter may be included for parting the preformed hanger to be fed between the end of the sheet of paper and the adjacent leg of the binding strip. The feed mechanism may include a sprocket engageable with sprocket holes in the tape.

The apparatus may also include paper feed mechanism for feeding a sheet of paper from a supply thereof such that its end is located between the legs of the binding strip. The invention also extends to a bound sheet of paper, in particular a calendar, with a hanger, which has been bound by the method or the apparatus of this invention.

BRIEF DESCRIPTION OF THE DRAWINGS

The objectives and features of the invention will become more readily apparent from the following detailed description taken in conjunction with the accompanying drawings in which.

DETAILED DESCRIPTION OF THE PREFERRED EMBODIMENT

Figure 4:
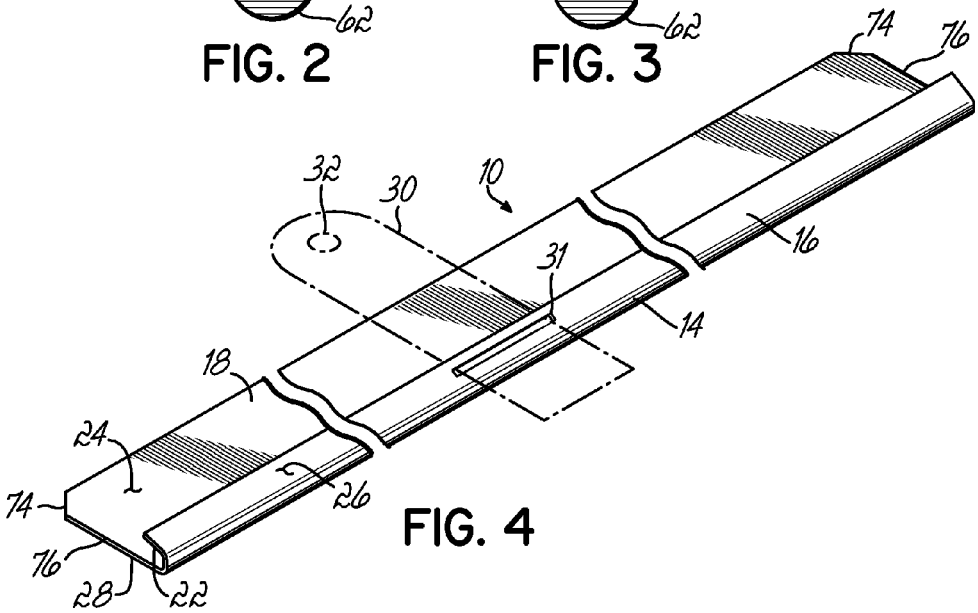
FIG. 4 is a perspective view of one embodiment of a slide according to this invention.

One presently preferred embodiment of a slide 10 according to this invention is shown in FIG. 4 and other embodiments are shown in the priority applications previously cited herein. It will be understood by those in the art that, while this invention may be described as a calendar slide or binding strip 10, the slide 10 may be used to bind and hang or display any other desired display item, such as a poster, document, banner, wall hanging, or workpiece 12. Moreover, a known calendar slide may also be utilized with various aspects of this invention.

The calendar slide or binding strip 10 is typically made from a strip of sheet metal, although other substances with similar characteristics could be used. The typical sheet metal used is a cold rolled mild steel plate with a thickness of approximately 0.0062 inches; however, other types and/or sizes of metal could also be used. The sheet metal is bent to form a longitudinal bend 14, which creates a generally U-shaped or V-shaped channel from the sheet metal strip. The longitudinal bend 14 in the sheet metal channel separates a first bend portion or leg 16 and a wider second bend portion or leg 18. According to one embodiment, the width of the first bend portion 16 is approximately 0.150 inches and the width of the second wider bend portion 18 is approximately 0.660 inches. In other embodiments of this invention, the second portion 18 may be only 0.4375 inches in width. These relative dimensions, while typical for usual applications, could be proportionally or non-proportionally altered for special applications. Similarly, while the slide 10 will normally have different size bend portions or legs 16, 18, a slide with generally the same size bend portions or legs 16, 18 may be used for unique applications. The angular separation between the first bend portion 16 and the wider second bend portion 18 is approximately 38 degrees, although a greater or lesser degree of initial, angular separation could be used for particular applications.

Moreover, the slide 10 of this invention in one embodiment has a U-shaped bend 14 with a generally planar bight portion (not shown. In other preferred embodiments of this invention the slide 10 has a V-shaped configuration with a more pointed vertex joining the legs 16, 18. In some applications, the U-shaped bend 14 with a bight portion accommodates thicker more bulky calendars which are more fully seated in the bight without skewing the pages of the calendar 12 as compared to the traditional V-shaped configuration. In other words, all of the aligned pages of the calendar 12 are able to fully abut against the bight portion prior to the tinning operation and without the upper or lower pages sliding relative to the remaining pages. Each bend portion 16, 18 has respective interior surfaces 22, 24 and respective exterior surfaces 26, 28. The exterior surfaces 26, 28 of the respective bend portions 16, 18 are normally coated, e.g., with paint, to prevent oxidization and/or to achieve a desired aesthetic effect.

In one embodiment, shown in FIG. 4, a hanger 30 is located at the longitudinal center of the slide 10. While normally only one hanger 30 is utilized, and thus it is desirous for it to be medially positioned, when two or more hangers 30 are used, they are preferably proportionally spaced on the slide 10. Moreover, the hanger 30 could, if desired, be located on any of the parts of the slide 10.

In one embodiment, the slide 10 of this invention includes at least one slot 31 sized and configured to receive the hanger 30 there through. In one embodiment, the slot 31 is located on the shorter leg 16 adjacent to the bend 14. However, the slot 31 may be located anywhere on the slide 10. Each hanger 30 includes a hole 32 through which a wall hanging device such as a hook or the head of a nail (not shown) may be inserted to suspend the calendar or work piece 12 when tinned with the slide 10. Preferably, the hole 32 has a generally circular shape as shown, but other shaped holes may be utilized within the scope of this invention.

Figure 1:
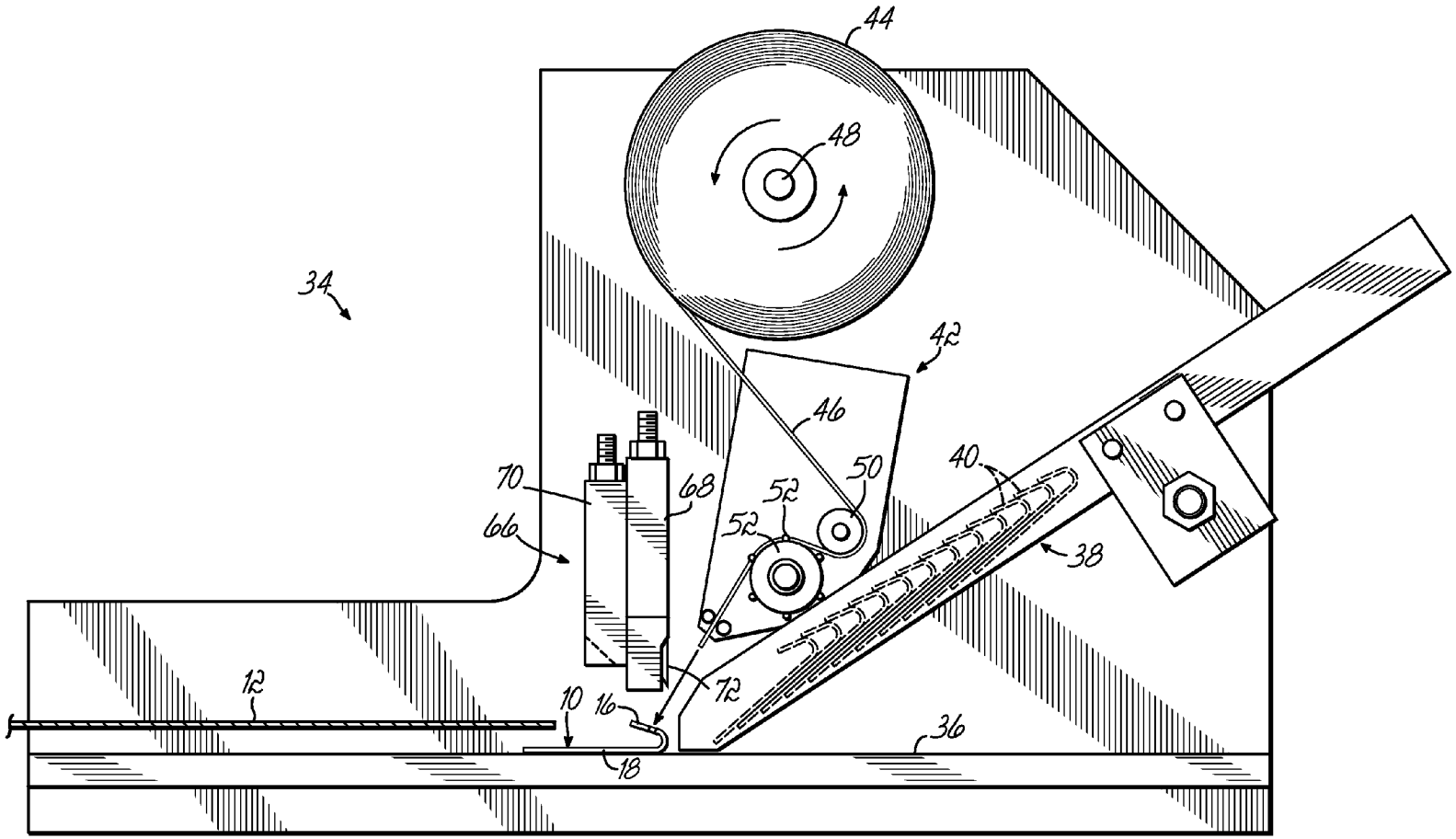
FIG. 1 is a side elevational, cross-sectional view of a system and associated method according to one embodiment of this invention for tinning a calendar with a slide and hanger.

Referring to FIG. 1, one embodiment of a tinning machine 34 is shown as well the associated operation of the machine 34 and method for tinning a calendar, display item or other document 12 with the slide 10 and hanger 30 according to this invention will be described. The machine 34 includes a generally horizontal platform 36 which may include appropriate conveyors or other delivery mechanisms for delivering the calendar 12 between the spaced legs 16, 18 of the slide 10 supported on the platform 36 according to this invention. The slide 10 is discharged from a slide delivery assembly 38 which is adapted to house a stack or magazine 40 of nested slides 10 in which the leading slide 10 is deposited onto the platform 36 for tinning with the calendar 12.

Figure 3:
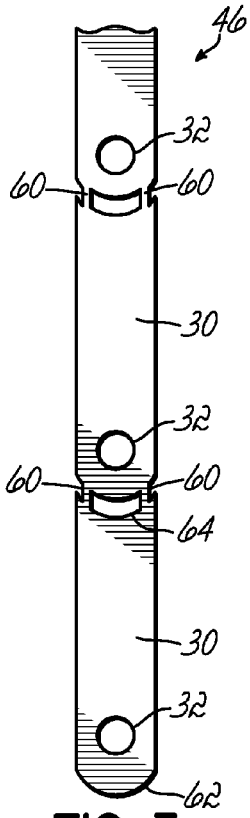

The machine 34 also includes a hanger delivery and insertion assembly 42 for inserting a hanger 30 into the slide 10 according to this invention. A roll 44 of hanger tape 46 is mounted for rotation on a spindle 48. The roll 44 of tape 46 is trained around a feed roller 50, an index roller 52, and a pair of insertion rollers 54 as shown generally in FIG. 1. The indexing roller 52 is rotationally driven and includes a series of pins 56 or similar projections projecting around the circumference of the roller 52. The pins 56 are sized, configured and spaced on the index roller 52 to project through the holes 32 in the hanger tape 46. The indexing roller 52 rotates to index the tape 46 through the insertion rollers 54 for delivery to the slide 10 positioned on the platform 36. Exemplary embodiments of hanger tape 46 are shown in FIGS. 2, 3, 5 and 6. In one embodiment, the hanger tape 46 may be generally continuous with or without perforations 58 indicating the portion of the tape 46 to be cut or severed to delineate the individual hangers 30. Alternatively, the hanger tape 46 may include a series of individual hangers 30 adjoined to each other by one or more bridges 60 joining the generally convex shaped distal edge 62 of each hanger 30 with the concave shaped proximal edge 64 of an adjacent hanger as shown in FIG. 3.

Figure 1A:
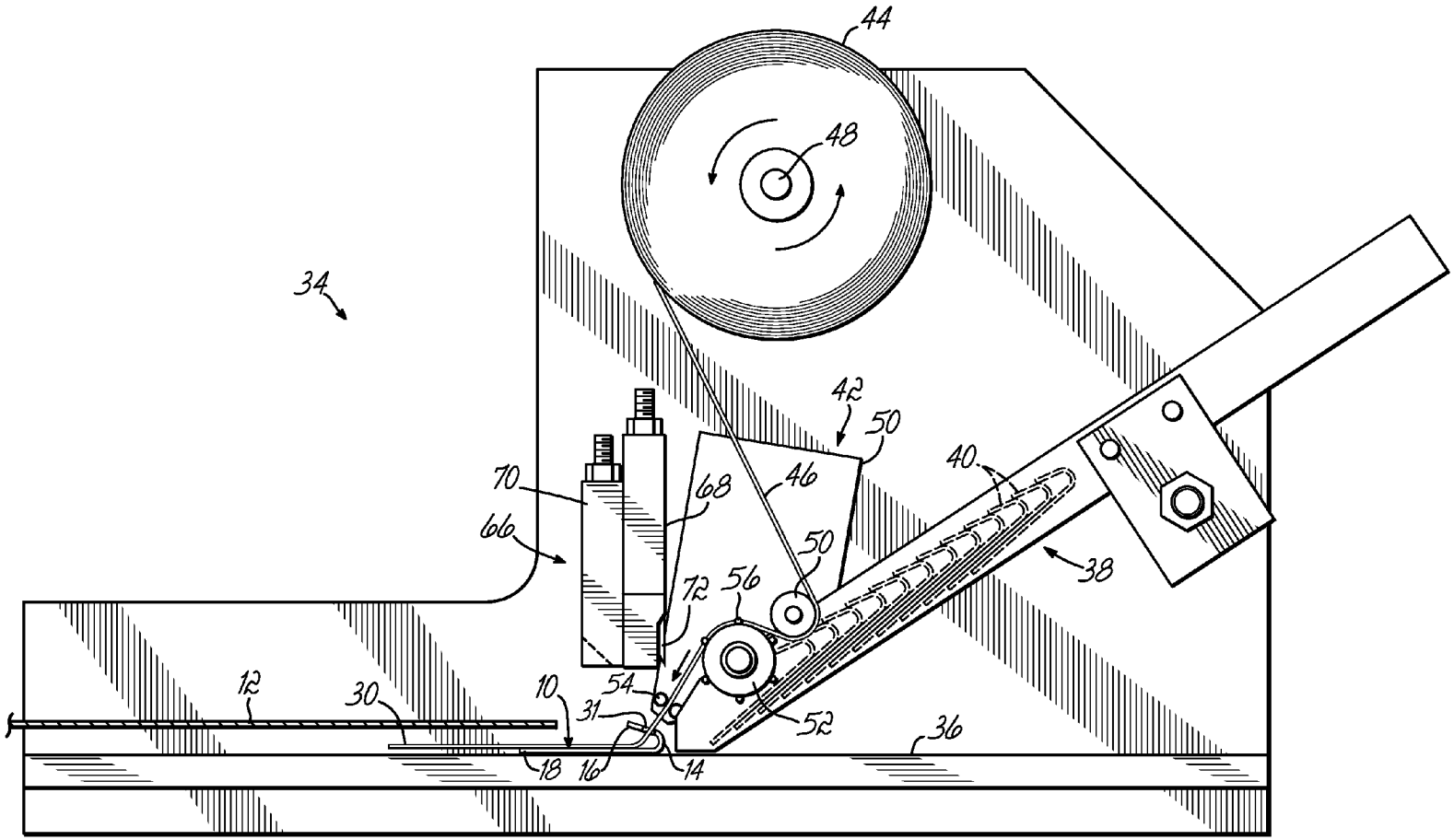
FIGS. 1A thru 1G are sequential views similar to FIG. 1 showing the operation of the system and the associated method for tinning the calendar.

The machine 34 also includes a crimping and cutting assembly 66 having a primary crimping tool 68 and a second crimping tool 70. The tinning operation begins by the leading slide 10 being deposited onto the platform 36 and the hanger tape 46 being dispensed from the roll 44 and indexed from the insertion rollers 54 by the indexing roller 52. The leading hanger 30 on the tape 46 is inserted through the slot 31 in the slide 10 on the platform 36. In one embodiment, the hanger insertion assembly 42 advances downwardly toward the slide 10 on the platform 36 for more accurate and reliable insertion of the tape 46 and through the slot 31 as shown in FIGS. 1A and 1B.

Figure 1C:
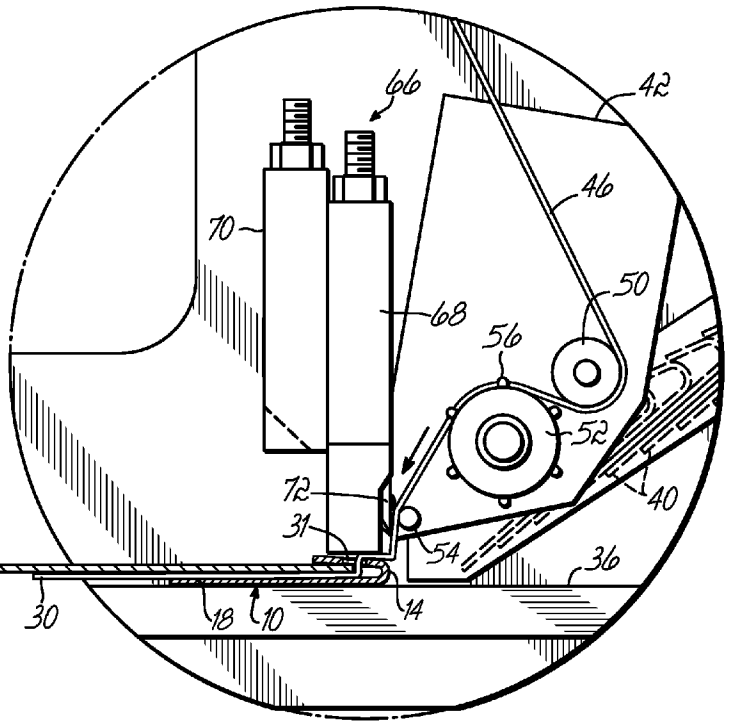
Figure 1B:
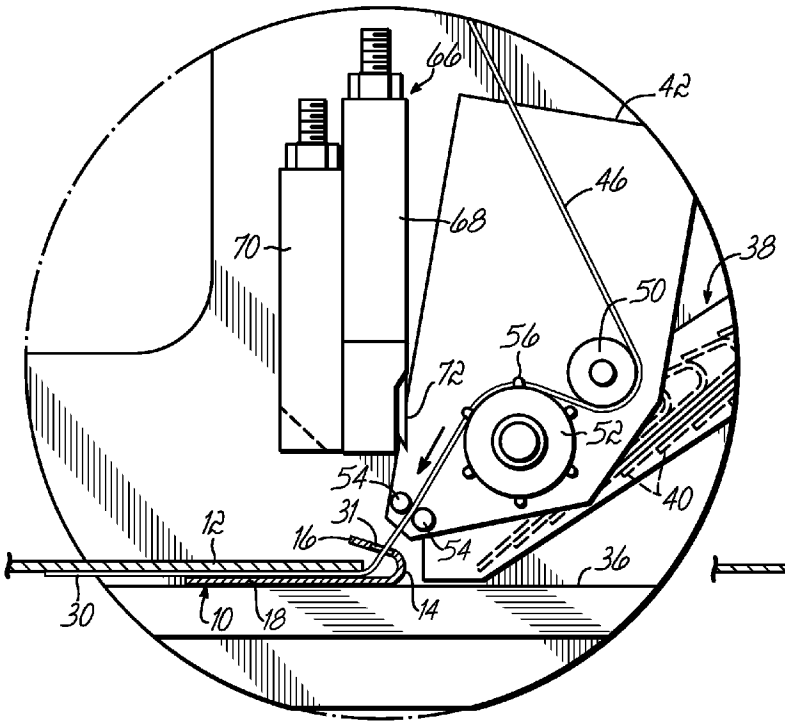

As shown in FIG. 1B, the edge of the calendar 12 is advanced into the open mouth of the slide 10 between the first and second legs 16, 18. The calendar 12 is positioned atop the hanger 30 inserted in the slide 10 as shown in FIG. 1B. As shown in FIG. 1B, once the hanger 30 is inserted through the slot 31, the crimping and cutting assembly 66 advances downwardly so that the primary crimping tool 68 engages the short leg 16 of the slide 10. The first crimping tool 68 crimps the leg 16 of the slide 10 onto the edge of the calendar 12 and likewise anchors and secures the hanger 30 in position relative to the slide 10 and the calendar 12 as shown in FIG. 1C. While the first crimping tool 68 initially crimps the slide 10 onto the edge of the calendar 12, a cutting blade 72 advances relative to the crimping tool 68 to engage the hanger tape 46 and sever the leading hanger 30 from the tape 46 as shown in FIG. 1C.

Figure 1E:
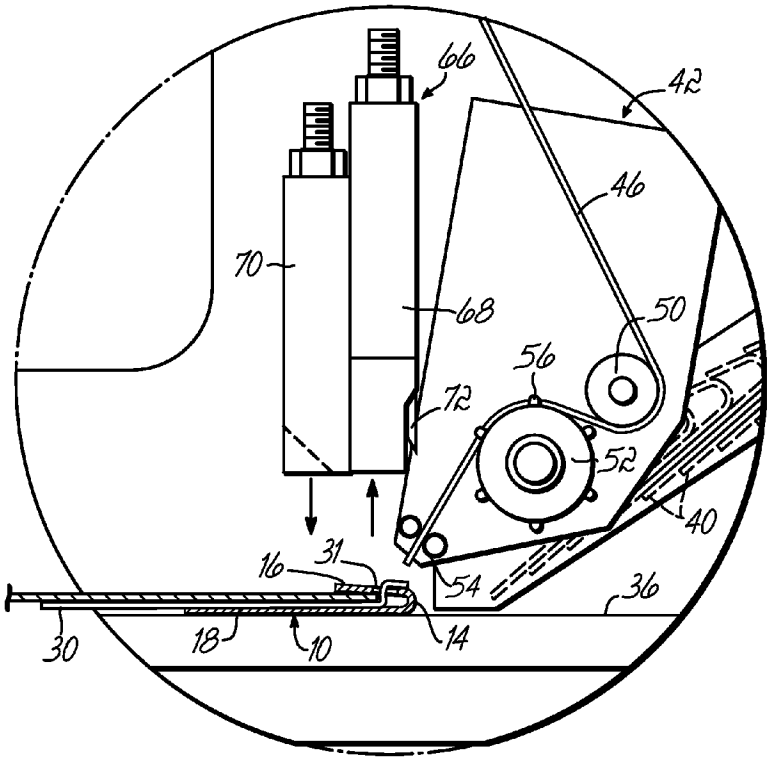
Figure 1D:
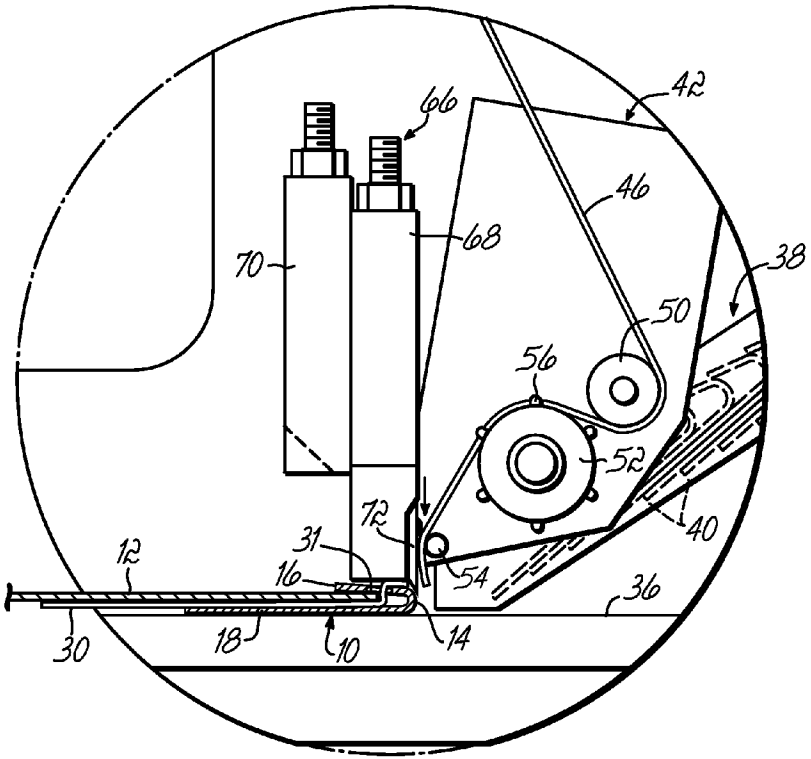
Figure 1G:
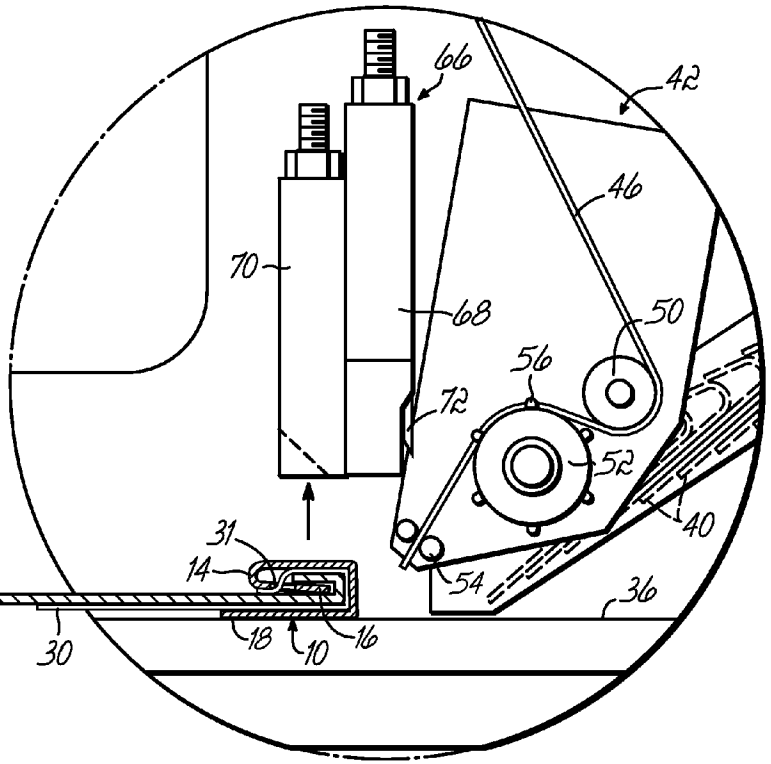
Figure 1F:
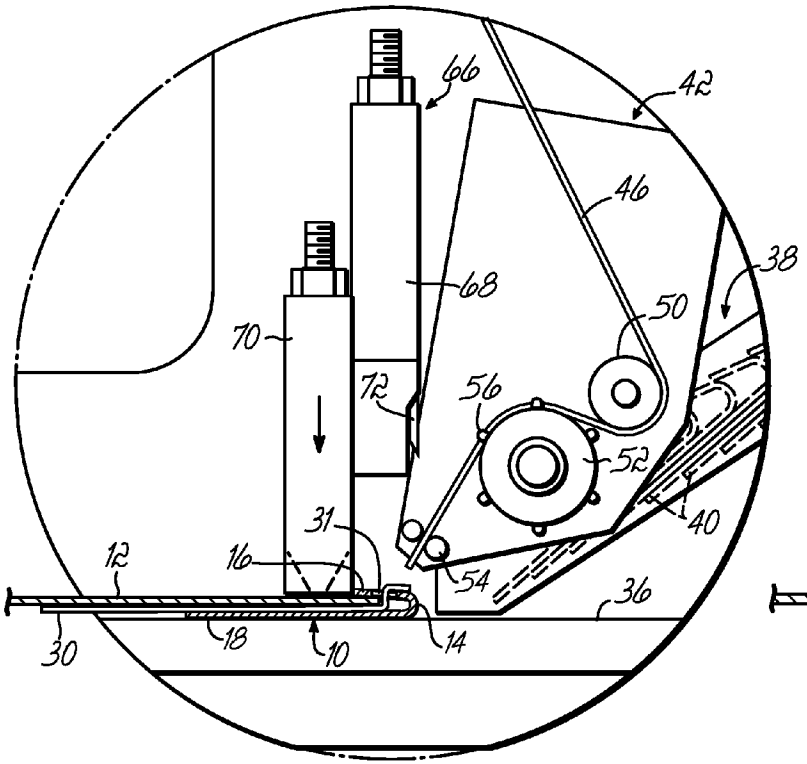
Figure 1H:
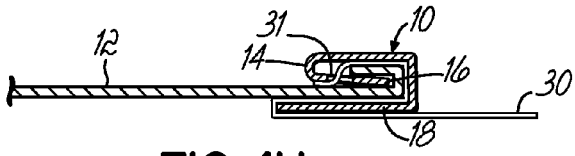
FIG. 1H is a cross-sectional view of the calendar tinned with the slide and hanger according to one embodiment of this invention.
Figure 2:
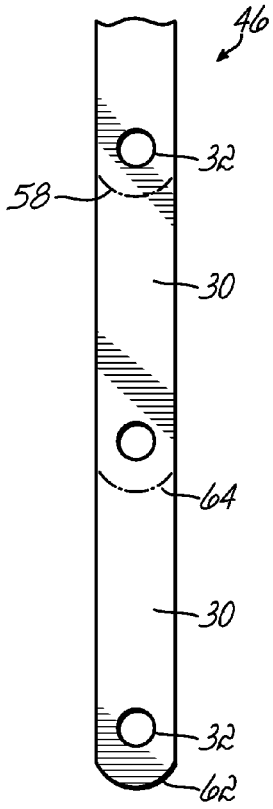
FIGS. 2, 3, 5 and 6 are top plan views of alternative embodiments of hanger tape used in the system and method according to this invention.

Subsequently, as shown in FIG. 1E, the first crimping tool 68 retracts from the slide 10 and the second crimping tool 70 advances downwardly to initiate and complete the subsequent crimping operation as shown in FIGS. 1F and 1G. After the hanger 30 is inserted through the slot 31 of the slide 10 and severed from the tape 46 and the first crimping operation anchors the hanger 30 relative to the slide 10 and crimps the first and second legs 16, 18 together on the edge of the calendar 12, the remainder of the crimping operation according to this invention can be performed by well known crimping and tinning operations, examples of which are shown in U.S. Pat. Nos. 5,707,194; 6,042,319; and 6,698,988, each of which are hereby incorporated by reference in their entirety. The calendar 12 and slide 10 after the completion of the tinning operation according to one embodiment of this invention is shown in FIG. 1H.

An additional advantage of this invention is that the supply of slides 10 having one or more slots 31 therein can not only be used for tinning a top edge of the calendar 12 with a hanger 30 as previously described, but can also be used for crimping a bottom edge or other edge of a document 12 with a slide 10 with or without a hanger 30 as is well known to provide a more finished display item. Therefore, separate inventories for slides with or without a hanger are no longer required thereby simplifying inventory and purchasing requirements.

Additional features of the slide 10 of FIG. 4 according to this invention include cropped corners 74 on the lateral ends 76 of the second leg 18 and/or the first leg 16 to inhibit snags, cuts or the like resulting from contact with this portion of the slide 10. Additionally, dimples (not shown) which may be convex or concave and placed on the first or second leg 16, 18 of the slide 10 adjacent the hanger 30 and/or the lateral ends 76 of the slide 10 may be included to assist in handling and manipulation of the slides 10 when stacked or nested together as described in the above-identified pending patent applications assigned to the assignee of this invention.

Figure 5:
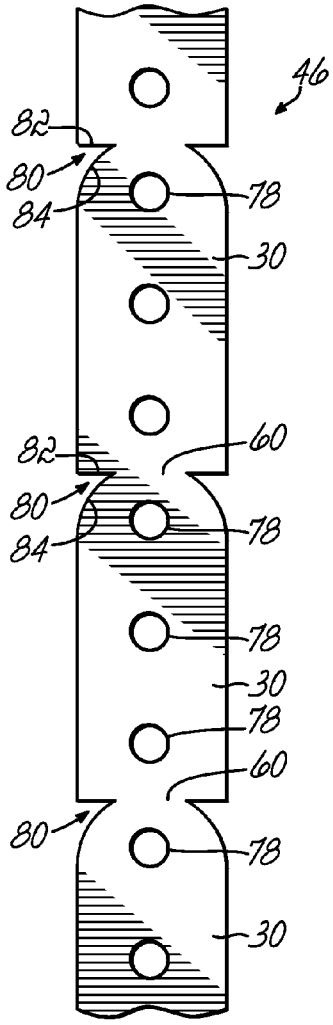

Referring to FIG. 5 of the drawings, an alternative embodiment of this invention include a length of tape 46 for providing a supply of flexible hangers 30 for a bound sheet of paper 12. The tape 46 is of plastics material and has feeding formations in the form of a plurality of longitudinally extending equispaced and centrally located sprocket holes 78.

The tape 46 also has cut-outs 80 on each of the sides thereof. Each cut-out 80 has a transverse linear side 82 and a curved side 84. The cut-outs 80 define bridges 60 between one another. A preformed hanger 30 is defined between successive cut-outs 80 along the length of the tape 46, with one of the sprocket holes 78 defining an eyelet opening 32 for the hanger 30.

Figure 6:
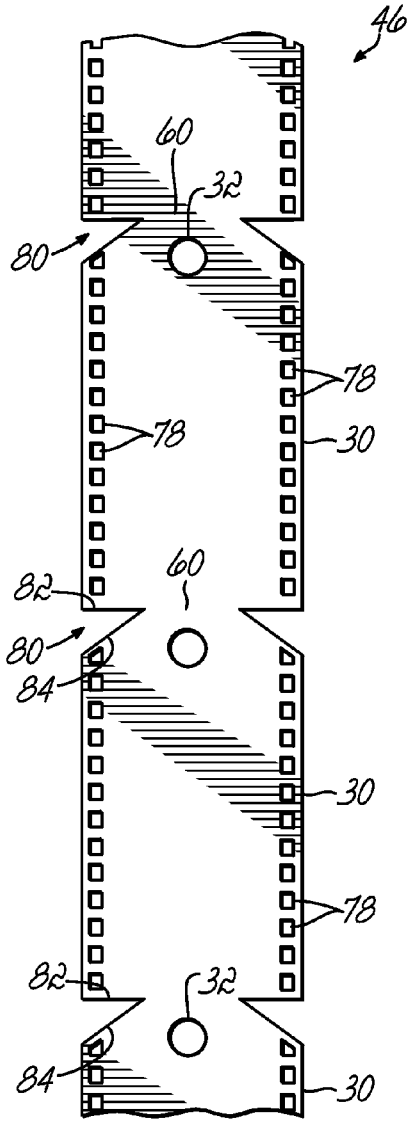

Referring now to FIG. 6, another embodiment of a length of tape 46 for providing a supply of flexible hangers 30 for a bound sheet of paper 12, in accordance with the invention is shown. The tape 46 has feeding formations in the form of a multiplicity of longitudinally extending equispaced sprocket holes 78 adjacent the sides of the tape 46 and a plurality of longitudinally extending equispaced central openings 32. The tape 46 has roughly triangular-shaped cut-outs 80 on each side thereof, with preformed hangers 30 being defined between successive cut-outs 80 along the length of the tape 46. Each cut-out 80 is defined by a straight transverse side 82 and a straight angled side 84. The cut-outs 80 define bridges 60 between one another. Each central opening 32 defines an eyelet opening for each hanger 30.

Figure 7:
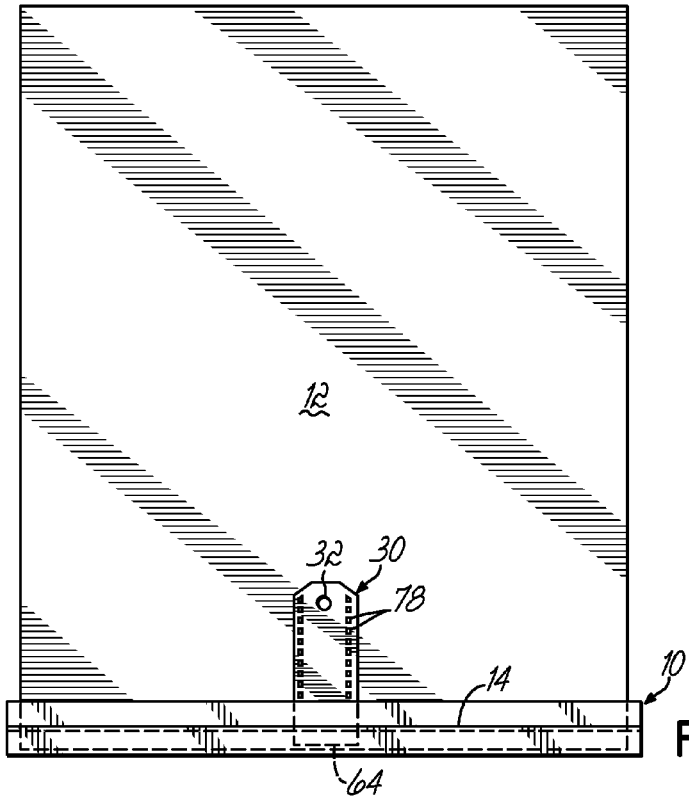
FIG. 7 is a top plan view of a calendar with a slide and hanger secured to one edge thereof according to one embodiment of this invention.

In FIG. 7, a bound sheet of paper in the form of a calendar with a hanger 30 is shown. The calendar comprises a sheet of paper 12 and a flexible hanger 30 secured to a metal slide or binding strip 10.

The binding strip 10 has two portions or legs 16, 18 angularly disposed to each other about a first fold line 14. The hanger 30 has an eyelet opening 32 and an edge 64 distal to the eyelet opening 32. An end of the sheet of paper 12 is located between the two legs 16, 18 against the fold line 14 of the binding strip 10. The edge 64 of the hanger 10 is also located between the sheet of paper 12 and one of the legs 16 or 18. The binding strip 10 is deformed by folding along a second fold line 86, such that both the sheet of paper 12 and the hanger 30 are secured thereto.

Figure 8:
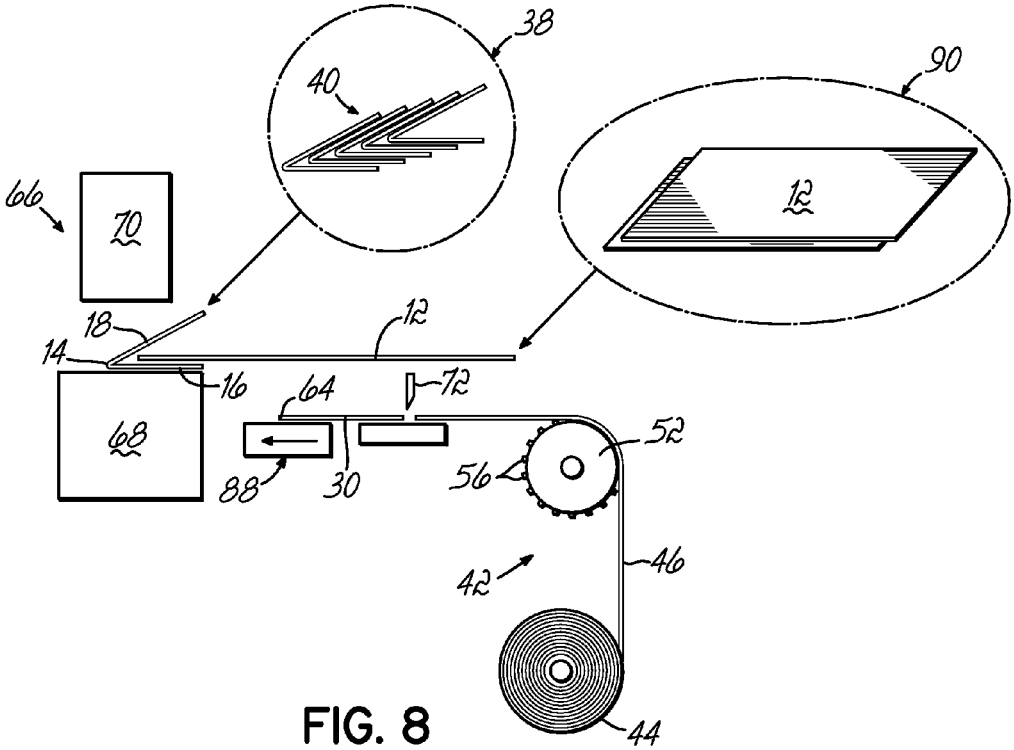
FIG. 8 is a schematic representation of a system and associated method for tinning a calendar with a slide according to one embodiment of this invention.

FIG. 8 shows one embodiment of an apparatus 34 for binding a sheet of paper 12, in accordance with the invention. The apparatus 34 includes a binding strip supply mechanism 38 for supplying partially folded over binding strips 10, a hanger supply mechanism 42 including a support 48 for a roll 44 of tape 46 for supplying preformed hangers 30, a reciprocating cutter 72 for parting preformed hangers 30 from the tape 46 and a hanger feed mechanism 88 for feeding an edge 64 of the preformed hanger 30 to one of the partially folded binding strips 10.

The apparatus 34 also has a paper feed mechanism 90 for feeding an end of a sheet of paper 12 from a supply thereof and also a deforming mechanism 66 having two opposed dies 68, 70 for deforming the binding strip 10 with the end of the sheet of paper 12 and the edge of the hanger 30 therein, to secure the sheet of paper 12 and hanger 30 thereto. The hanger feed mechanism 42 also includes a sprocket 52 engageable with sprocket holes 78 (see FIGS. 5 and 6). The reciprocating cutter 72 has a guillotine for severing the preformed hanger 30 from the tape 46.

In use, a partially folded over metal binding strip 10 is fed from the supply 40 into the deforming mechanism 66, between the two dies 68, 70. A sheet of paper 12 is then fed, via the feed mechanism 90 to the deforming mechanism 66 into the region between the two legs 16, 18 of the binding strip 10, with the edge thereof being located adjacent the fold line 14 formed between the two legs 16, 18. A length of tape 46 is advanced from the roll 44 thereof, with the tape 46 being engaged with the sprockets 56 on wheel 52 via sprocket holes 78. At the cutter 72, a preformed hanger 30 is severed from the tape 46 and its leading edge 64 fed into the binding strip 10 between an adjacent leg 16 or 18 thereof and an end of the sheet of paper 12, such that the edge 64 is also located adjacent the fold line 14 of the binding strip 10. The dies 68, 70 are brought towards each other and the binding strip 10 deformed, with the sheet of paper 12 and hanger 30 located there between. The dies 68, 70 are then opened and the deformed binding strip 10 is then folded over about a second fold line 86 parallel to the first fold line 14 and the binding strip 10 deformed further about this second fold line 86 with the result that the sheet of paper 12 and the hanger 30 are secured thereto.

Therefore, it is readily apparent from the disclosure of various embodiments of this invention, advantages not previously realized in prior art slides overcome problems associated with known slides.

From the above disclosure of the general principles of the present invention and the preceding detailed description of at least one preferred embodiment, those skilled in the art will readily comprehend the various modifications to which this invention is susceptible. Therefore, we desire to be limited only by the scope of the following claims and equivalents thereof.

We claim:

1. A slide for attaching to a display item comprising:

a longitudinal channel with a first lateral end and second lateral end and a longitudinal bend extending from the first lateral end to the second lateral end, the longitudinal bend joining a first leg and a second leg of the channel, the first and second legs each having respective interior confronting surfaces adapted to receive an edge of the display item there between and respective exterior surfaces;

wherein the bend is adapted to receive the edge of the display item there against;

a hanger having a hole proximate a distal end thereof and adapted to receive a hanging device there through for suspending the display item and slide; and a slot in the channel sized and configured to receive the hanger there through, the hanger being inserted through the slot and secured to the channel when the slide is crimped onto the display item.

2. The slide of claim 1 wherein the hole in the hanger is generally circular.

3. The slide of claim 1 further comprising:

a cropped corner at each lateral end of one of the legs of the channel.

4. The slide of claim 1 wherein the slot is in one of the legs of the channel.

5. The slide of claim 4 wherein the first leg is shorter than the second leg and the slot is in the first leg.

6. The slide of claim 1 wherein a first portion of the hanger is juxtaposed to an exterior surface of one of the legs and a second portion of the hanger is positioned between the legs of the slide proximate the interior surfaces of the legs.

7. The slide of claim 1 wherein a proximal end of the hanger spaced from the hole is secured to the slide.

8. The slide of claim 1 further comprising:

an indexing element on the hanger adapted to be engaged to index the hanger position relative to the slide.

9. The slide of claim 1 further comprising a plurality of slots in the slide and a plurality of hangers each inserted into one of the slots.

10. The slide of claim 1 wherein the slot is a through-slot in the slide.

11. A supply of members adapted to be fastened to a slide along an edge of a workpiece from which to suspend the workpiece, the supply comprising:

a plurality of serially connected hangers, each hanger having a distal end and a proximal end, the distal end of each hanger being coupled to a proximal end of an adjacent hanger, the distal and proximal ends of the adjacent hangers being severable from one another;

a hole in each hanger proximate the distal end thereof and adapted to receive therethrough a device from which the work piece is suspended; and a plurality of indexing elements formed in at least selected hangers, each indexing element adapted to be engaged to move the plurality of hangers.

12. The supply of claim 11 wherein selected indexing elements are located along a lateral side edge of the serially connected hangers.

13. The supply of claim 12 wherein the selected indexing elements are generally V-shaped notches proximate the respective distal and proximal ends of the adjacent hangers.

14. The supply of claim 12 wherein the selected indexing elements are sprocket holes.

15. The supply of claim 11 wherein selected indexing elements are located generally equal distance between the lateral side edges of the serially connected hangers.

16. The supply of claim 11 wherein the serially connected hangers form a concentrically wound tape.

17. The supply of claim 11 further comprising:

at least one bridge joining the respective distal and proximal ends of the adjacent hangers together, the respective distal and proximal ends of the adjacent hangers being spaced from each other.

18. A method for securing a slide and a hanger onto an edge of a workpiece, the method comprising the steps of:

feeding a leading hanger from a supply of serially connected hangers;

severing the leading hanger from the supply of serially connected hangers;

inserting an edge of workpiece between a pair of legs of the slide;

inserting the leading hanger into the slide; and crimping the slide and the leading hanger onto the edge of the workpiece.

19. The method of claim 18 wherein the crimping step further comprises:

folding the legs of the slide toward each other about a first fold line with the edge of the workpiece and the leading hanger juxtaposed thereto; and folding the slide about a second fold line generally parallel to the first fold line.

20. The method of claim 18 wherein the feeding step further comprises:

paying out the leading hanger from the supply of serially connected hangers concentrically wound around a supply roll; and rotating an indexing roller in contact with a portion of the serially connected hangers; and engaging sprockets projecting from the indexing roller with indexing elements in the portion of the serially connected hangers.

21. The method of claim 18 wherein the step of inserting the leading hanger further comprises:

inserting a portion of the leading hanger into a slot in the slide.

22. The method of claim 18 wherein the step of inserting the leading hanger further comprises:

juxtaposing a portion of the leading hanger between the workpiece and one of the legs of the slide.

23. The method of claim 18 wherein the leading hanger is separable from the slide prior to the crimping step.

24. A system for securing a slide and a hanger onto an edge of a workpiece, the system comprising:

a feeding mechanism adapted to feed a leading hanger from a supply of serially connected hangers;

a severing mechanism adapted to separate the leading hanger from the supply of serially connected hangers;

a platform adapted to support a workpiece to be inserted between a pair of legs of the a slide; and a crimping mechanism adapted to secure the leading hanger and the slide to the edge of the workpiece.

25. The system of claim 24 wherein the feeding mechanism is adapted to insert the leading hanger into a slot in the slide.

26. The system of claim 24 wherein the feeding mechanism further comprises:

an indexing roller having a plurality of sprockets projecting therefrom and adapted to engage indexing elements in the supply of serially connected hangers.

* * * * *